US005266841A

United States Patent [19]

Flegel

[11] Patent Number: 5,266,841

[45] Date of Patent: Nov. 30, 1993

[54] SWITCH ASSEMBLY FOR A TIMING MODULE

[75] Inventor: David D. Flegel, Racine, Wis.

[73] Assignee: Reliance Time Controls, Inc., Milwaukee, Wis.

[21] Appl. No.: 785,526

[22] Filed: Oct. 31, 1991

[51] Int. Cl.[5] ..... H01H 43/00

[52] U.S. Cl. ..... 307/141; 307/113; 307/141.8

[58] Field of Search ..... 307/112, 113, 116, 125, 307/134, 139, 140, 141, 141.8; 200/38 R

[56] References Cited

U.S. PATENT DOCUMENTS 3,731,174 5/1973 Harris ..... 307/141.4
3,833,818 9/1974 Harris ..... 307/141 R
3,866,101 2/1975 Burzen ..... 307/141.4
3,925,683 12/1975 Link et al. ..... 307/141
4,766,331 3/1988 Flegel et al. ..... 307/141

*Primary Examiner*—Jeffrey A. Gaffin
*Attorney, Agent, or Firm*—Andrus, Sceales, Starke & Sawall

[57] ABSTRACT

A timing device incorporates a timing module having a relatively low capacity for use in a heavier application than it could normally be used due to the low capacity of the timing module switch contacts. The timing module output is connected with a solenoid having an extendable and retractable plunger, and a mechanical actuator arrangement is connected to the plunger. A high-capacity set of switch contacts are connected in the circuit, and the mechanical actuator arrangement controls opening and closing of the high-capacity switch contacts in response to extension and retraction of the solenoid plunger.

14 Claims, 3 Drawing Sheets

SWITCH ASSEMBLY FOR A TIMING MODULE

BACKGROUND AND SUMMARY

This invention relates to timed electrical switches, and more particularly to a switching mechanism responsive to a timed electrical switch.

Timing modules are known in the art, and generally include a power input and a power output, a timing mechanism, and a switch responsive to operation of the timing mechanism for controlling supply of power to the power output. The timing mechanism can either be a conventional motor-operated mechanism or a digital electronic timer, for selectively supplying and cutting off power to the timing module power output. Timing modules of this type are relatively inexpensive and reliable, and provide relatively easy operation by a user.

A typical timing module of the type summarized above has a switch mechanism rated for approximately 20 amps of electrical current. Thus, it has not been possible to employ a timing module of this type in a heavier application, such as supplying electrical power to equipment such as water heaters, billboard lights, swimming pool pumps or the like.

The present invention has as its object to adapt a timing module of the type summarized above for use in a heavier application than it otherwise could be employed by direct connection to the load due to the low capacity of the timing module switch. It is another object of the invention to provide a timing device incorporating such a timing module. Yet another object of the invention is to provide a simple and inexpensive timing device which is easily operated by the user, yet which can be employed in relatively heavy applications.

In accordance with the invention, a timing device for connection in an electrical circuit includes a timing module as summarized above, in which the timing module power input is interconnected in the electrical circuit to provide electrical power thereto. A mechanical switch mechanism is connected in the electrical circuit for controlling the supply of power to an electrical load. An actuator mechanism is interposed between the timing module power output and the mechanical switch mechanism for selectively actuating the mechanical switch mechanism in response to electrical power output from the timing module power output, to supply power to the electrical load through the mechanical switch mechanism. The actuator mechanism includes an output member which is movable in response to the supply of electrical power from the timing module power output, and a mechanical actuator arrangement interconnected between the movable output member and the mechanical switch mechanism. The output member and the mechanical actuator arrangement acting on the mechanical switch mechanism in response to electrical power supplied to the power output of the timing module, to control the supply of power in the electrical circuit through the mechanical switch mechanism. The movable output member is defined by the extendable and retractable plunger of a solenoid, which is interconnected with the timing module power output so as to selectively extend and retract the solenoid plunger in response to operation of the switching mechanism of the timing module. The mechanical switch mechanism has a movable switch contact member and a stationary switch contact member, and the mechanical actuator arrangement includes a cam member movable in response to extension and retraction of the solenoid plunger to control the position of the movable switch contact. The cam member is mounted to a pivotable shaft, and an actuating lever is connected between the solenoid plunger and the pivotable shaft for selectively providing pivoting movement of the shaft, and thereby movement of the cam member, in response to extension and retraction of the solenoid plunger. In a preferred form, the electrical circuit in which the timing device is connected is an AC circuit, and the solenoid is DC operated, and an AC to DC power converter is interposed between the timing module power output and the solenoid to convert AC power from the timing module power output to DC power supplied to the solenoid.

The invention further contemplates a method of connecting a timing module in an electrical circuit, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
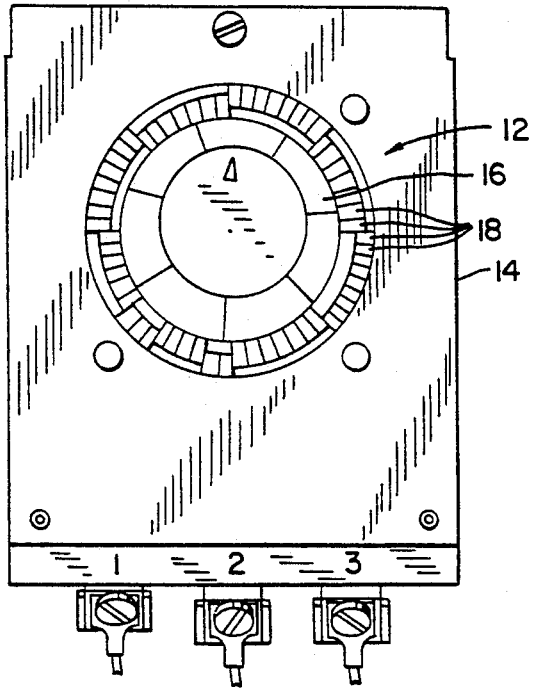
FIG. 1 is a top plan view of the timing device constructed according to the invention.

FIG. 1 illustrates a timing device 10 constructed according to the invention, incorporating a conventional timing module 12 and a mounting arrangement including a top plate 14 having an opening through which the face of timing module 12 is exposed. Timing module 12 may be that such as manufactured by Diehl under its Part No. 18801-023, which includes an internal 120 volt 60 Hz motor for imparting rotation to a dial 16. Timing module 12 further includes a power input having a pair of prongs 17*a*, 17*b* (FIG. 2) through which power is supplied to timing module 12, and a switch responsive to the position a series of tabs 18 for selectively providing electrical power to a power output having a pair of prongs 19*a*, 19*b* (FIG. 2) through the internal timing module switch.

The internal switch of timing module 12 has a relatively low capacity, e.g. 20 amps, and thus cannot be wired directly into a circuit for supplying electrical power to a heavy load, such as a water heater, swimming pool pump or billboard lighting.

Figure 2:
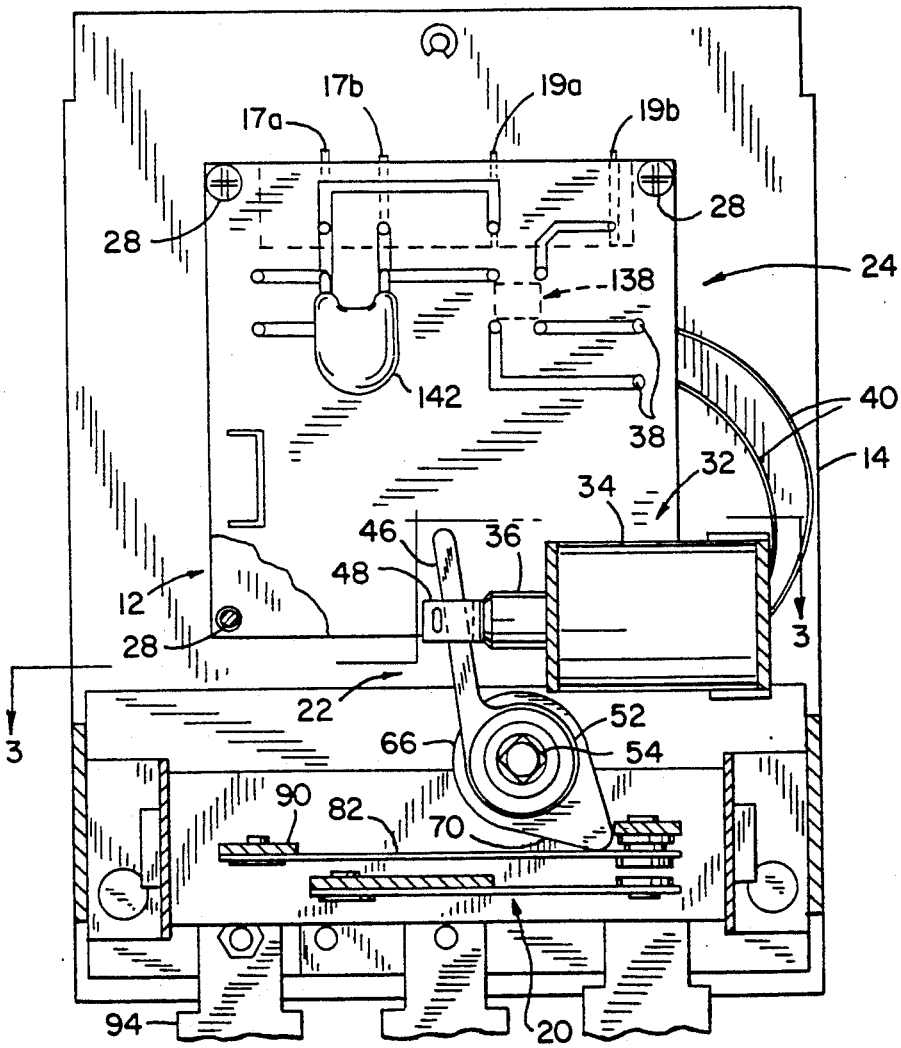
FIG. 2 is a rear plan view, with portions removed for clarity, of the timing device of FIG. 1.

The invention provides a mechanism for adapting timing module 12 for use in a heavier electrical circuit than it could otherwise be used due to the low capacity of the timing module internal switch. Referring to FIG. 2, which illustrates the rear elevation view of timing device 10, the invention provides an auxiliary mechanical switch mechanism shown generally at 20, a movable actuator arrangement 22 for controlling the position of auxiliary mechanical switch mechanism 20, and a circuit board 24 for selectively supplying electrical power to actuator arrangement 22 in response to power supplied to the power output of timing module 12.

Figure 4:
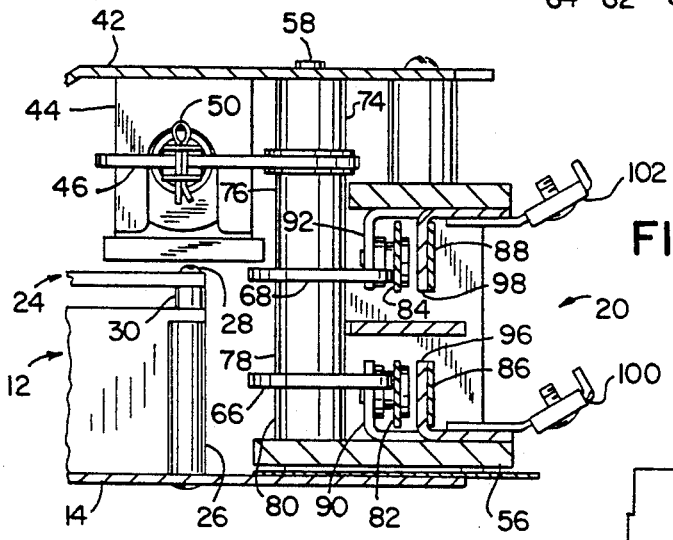
FIG. 4 is a side elevation view of the timing device of FIG. 1–3.

Referring to FIGS. 2 and 4, timing module 12 is mounted to front plate 14 by means of a series of cylindrical mounting studs 26, which are fixed to front plate 14 and located at the corners of timing module 12, and a series of screws 28 which are engageable with threaded internal passages formed in studs 26. Circuit board 24 is spaced rearwardly of the rear surface of timing module 12, with spacers 30 (FIG. 4) being disposed between timing module 12 and circuit board 24, and through which screws 28 extend for engagement with the internal passages of studs 26.

Figure 3:
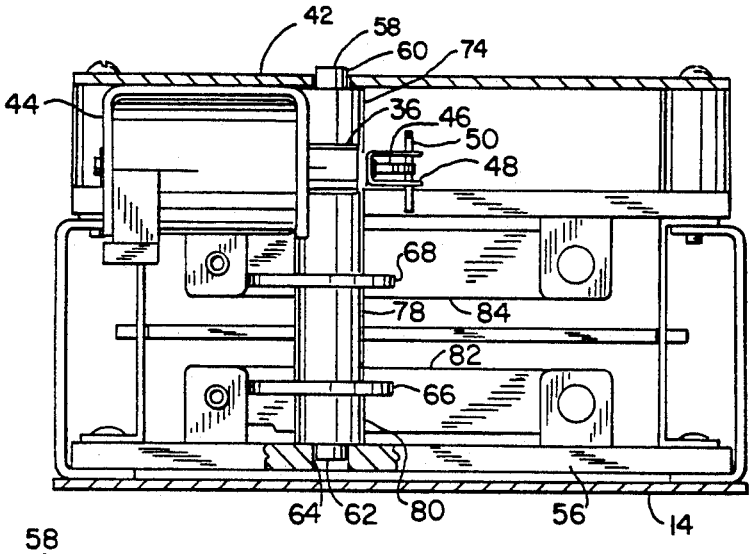
FIG. 3 is a section view taken generally along line 3—3 of FIG. 2.

As shown in FIGS. 2-4, actuator arrangement 22 includes a solenoid 32 having a cylinder 34 encasing an internal coil, a pair of external terminals (not shown) leading to the internal coil, and a plunger 36. Circuit board 24, the circuitry of which will be explained, includes a pair of output terminals 38 (FIG. 2) with which a pair of wires 40 are connected, for supplying power from circuit board 24 to solenoid 32. Solenoid 32 is a DC operated solenoid of well known construction; a typical solenoid used in the invention is #56874-60 manufactured by Deltrol Controls of Milwaukee, Wis. The DC operation of solenoid 32 provides relatively quiet operation, in contrast to an AC solenoid. Solenoid 32 is mounted to a rear plate 42 (FIGS. 3, 4) by means of a mounting bracket 44.

Actuator arrangement 22 further includes a lever 46 which extends through a U-shaped bracket 48 mounted to the end of solenoid plunger 36, and is retained therewithin by means of a pin 50. Lever 46 extends from a circular base portion 52 (FIG. 2), through which a shaft 54 extends. Shaft 54 has a square cross-section to mate with square opening formed in lever base portion 52.

Referring to FIGS. 3 and 4, an insulating block 56 is mounted to the rear side of front plate 14. Shaft 54 extends between rear plate 42 and insulating block 56, and is rotatably supported by means of a circular end portion 58 engaging a circular opening 60 formed in rear plate 42, and a circular end portion 62 engaging a circular opening 64 formed in insulating block 56.

A pair of cam members 66, 68 are mounted to shaft 54, and include square openings therethrough for mating with shaft 54. Cam members 66, 68 each include a cam surface, such as shown at 70.

Referring to FIGS. 3 and 4, shaft 54 extends through a series of cylindrical spacers 74, 76, 78 and 80, to fix the location of lever base portion 52 and cams 66 and 68 along the length of shaft 54 between insulating block 56 and rear plate 42.

Again referring to FIGS. 2-4, auxiliary mechanical switch mechanism 20 includes a pair of movable switch contact members 82, 84 and a pair of stationary contact members 86, 88. Movable contact members 82, 84 are electrically connected to base members 90, 92, respectively, each of which forms a part of a terminal, such as 94 (FIG. 2) for connection in the electrical circuit in which the electrical load is connected. Similarly, stationary contact members 86, 88 are electrically connected to base members 96, 98, respectively, which form a part of terminals 100, 102, respectively, adapted for connection in the electrical circuit. The terminals 90, 92 to which movable contact members 82, 84 are mounted comprise one of the power input or power output of the electrical circuit, and terminals 100, 102, to which stationary contact members 86, 88 are mounted through base members 96, 98, respectively, define the other of the power input or power output of the electrical circuit. In addition, a set of terminals is provided for a neutral line.

Movable switch contact members 82, 84 are movable between an open position, as shown in FIG. 4 in which they are moved out of engagement with stationary switch contacts 86, 88, and a closed position in which they engage stationary switch contacts 86, 88. In their open position, movable switch contacts 82, 84 cut off the supply of electrical power in the circuit in which timing device 10 is connected, and in their closed position provide supply of electrical power in the circuit. Movable switch contacts 82, 84 are biased toward their open position, and are engaged by the cam surfaces, such as 70, of cam members 66, 68, for controlling movement between their opened and closed positions as will be explained.

Figure 5:
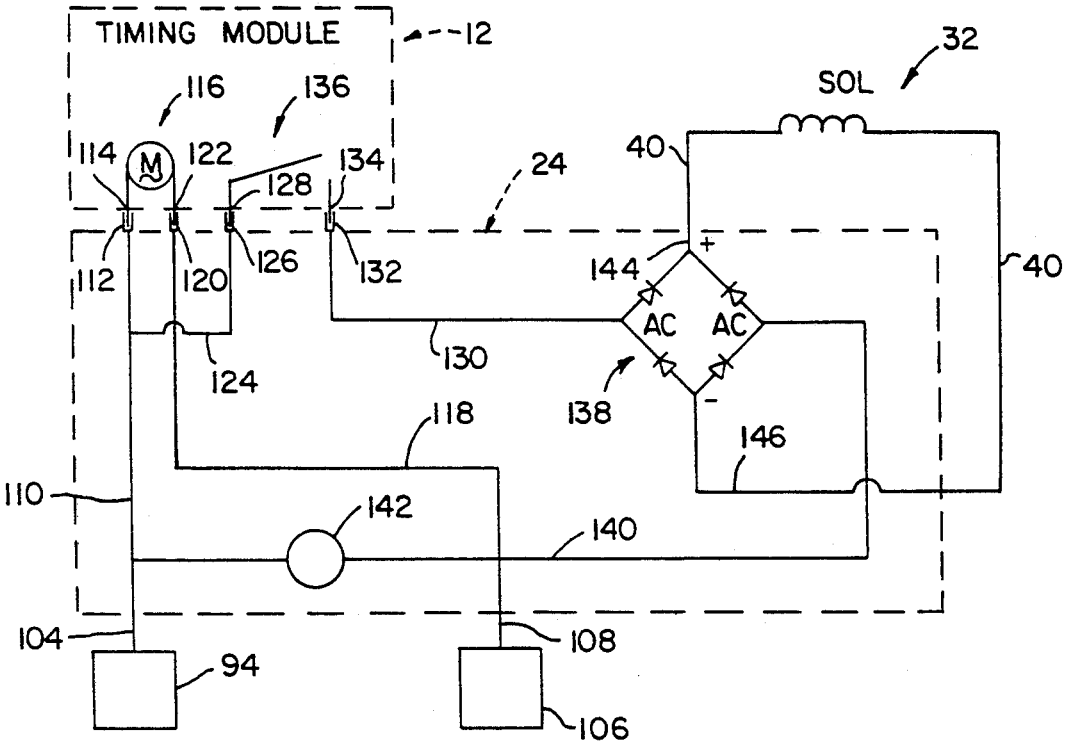
FIG. 5 is an electrical schematic showing interconnection of the timing module with the electrical circuit and the solenoid.

FIG. 5 schematically illustrates the circuitry provided by circuit board 24 and its interconnection with solenoid 32. AC electrical power is input to circuit board 24 from one of the timing device terminals, such as 94, which receives electrical power from the circuit in which timing device 10 is connected. The AC power is supplied to circuit board 24 through a wire 104. Similarly, ground potential is supplied to circuit board 24 from a ground terminal 106 connected in the electrical circuit, by means of a wire 108. A bus 110 is formed in circuit board 24 for supplying AC power to a connector 112, which is engaged with a prong 114 providing power input to the motor 116 of timing module 12. Similarly, a bus 118 provides ground potential to timing module motor 116 through a connector 120 and a timing module prong 122. A bus 124 provides AC power from bus 110 to a connector 126, which is engaged with a power input prong 128 of timing module 12. A bus 130 is engaged by means of a connector 132 with the timing module output prong 134, which selectively receives AC electrical power from timing module 12 in response to closing of the timing module switch, shown schematically at 136.

Power output bus 130 of circuit board 24 is connected to an AC terminal of a bridge rectifier 138 mounted to circuit board 24. Bridge rectifier 38 is of conventional construction, such as made by General Electric under its Model No. DB1M or General Instrument under its Model No. DF06M, for converting input AC power to output DC power. The other AC input of bridge rectifier 138 is connected via a bus 140 with circuit board power input bus 110 and ground potential bus 118. A surge suppressor 142 is mounted to circuit board 24 in bus 140 for protecting bridge rectifier 138 from the effects of electrical surges in input power thereto.

Circuit board 24 further includes a DC positive voltage bus 144 interconnected via one of wires 40 with the positive terminal of solenoid 32, and a DC negative voltage bus 146 interconnected via the other of wires 40 with the negative terminal of solenoid 32.

The physical components of circuit board 24 are illustrated to a certain extent in FIG. 2.

In operation, timing device 10 functions as follows. Timing module 12 is first set as desired according to the schedule in which power is to be supplied to and cut off from the circuit in which timing device 10 is connected.

During times in which it is desired to cut off the supply of electrical power in the circuit, the timing module internal switch 136 (FIG. 5) remains open and no power is output therefrom. In this situation, plunger 36 of solenoid 32 is extended as shown in FIGS. 2 and 4, such that movable switch contact members 82, 84 are disengaged from stationary switch contact members 86, 88. Such placement of movable switch contact members 82, 84 in their open position cuts off the supply of electrical power in the circuit. When internal switch 136 of timing module 12 is closed according to the predetermined schedule set by the user, AC electrical power is output from timing module 12 through its output prong 134 and to power output bus 130 of circuit board 24, to supply AC power to both AC terminals of bridge rectifier 138. When this occurs, DC power is output to solenoid 32 through buses 144, 146 and wires 40 to retract plunger 36 of solenoid 32. This rotates lever 46 (FIG. 2) clockwise about an axis defined by shaft 54, resulting in clockwise rotation of shaft 54 and thereby cam members 66, 68. The cam surfaces, such as 70 of cam members 66, 68, then move movable switch contact members 82, 84, respectively, to their closed position, to engage stationary contact members 86, 88 and to supply power in the circuit in which timing device 10 is connected.

Subsequent movement of timing module switch 136 to its open position cuts off the supply of power to bridge rectifier 138 and thereby to solenoid 32. Solenoid plunger 36 is then extended due to the movement of movable switch contact members 82, 84 to their open position which rotates cam members 66, 68 counterclockwise to move lever 46 leftwardly.

Figure 6:
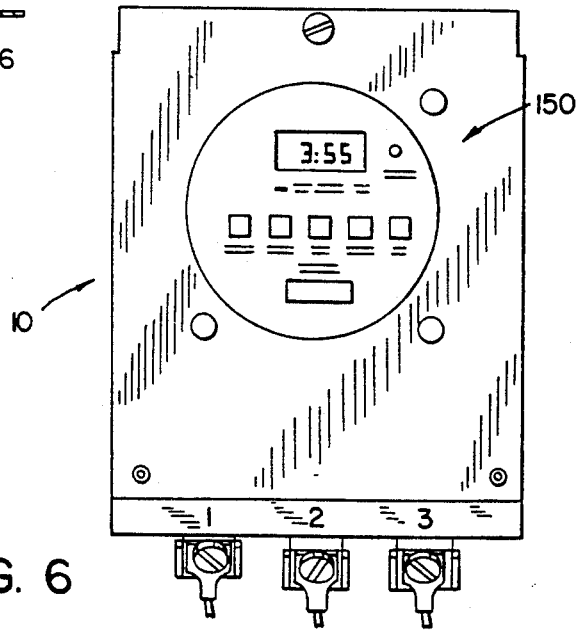
FIG. 6 is a view similar to FIG. 1, showing an alternate timing module usable in the timing device of the invention.

FIG. 6 illustrates an alternate embodiment of the invention, in which a digital electronic timing module 150 is employed in place of mechanical timing module 12. Digital electronic timing module 150 may illustratively be such as manufactured by Frontier Technology Company of Taipei, Taiwan under its Part No. TH-817-1.

The invention provides a simple timing device which adapts a relatively low-capacity timing module for use in a heavier circuit by the timing module supplying power to a solenoid, which is mechanically interconnected with a high-capacity switch arrangement for selectively supplying power in the circuit in response to operation of the solenoid, controlled in response to power output from the timing module.

Various alternatives and embodiments are contemplated as being within the scope and spirit of the following claims particularly pointing out and distinctly claiming the subject matter regarded as the invention.

I claim:

1. A timing device for connection in an electrical circuit, comprising:

a timing module, including a power input, a timing mechanism, and a first switch operable in response to the timing mechanism for selectively supplying power to a power output, wherein the timing module power input is interconnected in the electrical circuit;

a mechanical switch mechanism interconnected with the electrical circuit for controlling the supply of electrical power in the circuit; and an actuator mechanism interposed between the timing module power output and the mechanical switch mechanism for selectively actuating the mechanical switch mechanism in response to electric power output from the timing module output to supply power in the electrical circuit through the mechanical switch mechanism, the actuator mechanism comprising an output member movable in response to supply of electrical power from the timing module power output, and a mechanical actuator arrangement interconnected between the movable output member and the mechanical switch mechanism for acting on the mechanical switch mechanism for selectively providing power to the electrical circuit through the mechanical switch mechanism in response to electrical power supplied to the power output of the timing module.

2. A timing device for connection in an electrical circuit, comprising:

a timing module, including a power input, a timing mechanism, and a first switch operable in response to the timing mechanism for selectively supplying power to a power output, wherein the timing module power input is interconnected in the electrical circuit;

a mechanical switch mechanism interconnected with the electrical circuit; and an actuator mechanism interposed between the timing module power output and the mechanical switch mechanism for selectively actuating the mechanical switch mechanism in response to electrical power output from the timing module output to supply power in the electrical circuit through the mechanical switch mechanism, the actuator mechanism comprising an output member movable in response to supply of electrical power from the timing module power output, and a mechanical actuator arrangement interconnected between the movable output member and the mechanical switch mechanism for acting on the mechanical switch mechanism for selectively providing power to the electrical circuit through the mechanical switch mechanism in response to electrical power supplied to the power output of the timing module;

wherein the timing module switch comprises a second mechanical switch mechanism having a relatively low capacity, and wherein the first-mentioned mechanical switch mechanism comprises a relatively high capacity switch mechanism, to allow the timing module to be used in a higher amperage circuit than it otherwise would be used.

3. A timing device for connection in an electrical circuit, comprising:

a timing module, including a power input, a timing mechanism, and a first switch operable in response to the timing mechanism for selectively supplying power to a power output, wherein the timing module power input is interconnected in the electrical circuit;

a mechanical switch mechanism interconnected with the electrical circuit; and an actuator mechanism interposed between the timing module power output and the mechanical switch mechanism for selectively actuating the mechanical switch mechanism in response to electrical power output from the timing module output to supply power in the electrical circuit through the mechanical switch mechanism, the actuator mechanism comprising an output member movable in response to supply of electrical power from the timing module power output, and a mechanical actuator arrangement interconnected between the movable output member and the mechanical switch mechanism for acting on the mechanical switch mechanism for selectively providing power to the electrical circuit through the mechanical switch mechanism in response to electrical power supplied to the power output of the timing module;

wherein the actuator mechanism output member comprises the extendable and retractable plunger of a solenoid, wherein the solenoid is interconnected with the timing module power output so as to selectively extend and retract the solenoid plunger in response to operation of the timing mechanism of the timing module, and wherein the mechanical actuator arrangement is interconnected with the solenoid plunger.

4. The timing device of claim 3, wherein the mechanical switch mechanism comprises a movable switch contact member and a stationary switch contact member, wherein the movable switch contact member is movable between an open position in which it is disengaged with the stationary contact member, and a closed position in which it is engaged with the stationary contact member, and wherein the mechanical actuator arrangement includes a cam member movable in response to extension and retraction of the solenoid plunger to control movement of the movable switch contact member between its open and closed positions.

5. The timing device of claim 4, wherein the mechanical actuator arrangement further comprises a pivotable shaft to which the cam member is mounted, and an actuating lever connected between the solenoid plunger and the pivotable shaft for selectively providing pivoting movement of the shaft, and thereby movement of the cam member, in response to extension and retraction of the solenoid plunger.

6. The timing device of claim 4, wherein the mechanical switch mechanism comprises a pair of movable contact members and a pair of stationary contact members, and further comprising a second cam member mounted to the shaft for controlling movement of a second one of the movable contact members between its open and closed positions.

7. The timing device of claim 3, wherein the electrical circuit comprises an AC circuit, and wherein the actuator mechanism output member comprises the extendable and retractable plunger of a DC operated solenoid, and further comprising an AC to DC power conversion device interposed between the timing module power output and the solenoid for converting AC power from the timing module power output to DC power supplied to the solenoid.

8. A timing device for connection in an electrical circuit, comprising:

a timing module, including a power input, a timing mechanism, and a first switch operable in response to the timing mechanism for selectively supplying power to a power output, wherein the timing module power input is interconnected in the electrical circuit;

a mechanical switch mechanism interconnected with the electrical circuit; and an actuator mechanism interposed between the timing module power output and the mechanical switch mechanism for selectively actuating the mechanical switch mechanism in response to electrical power output from the timing module output to supply power in the electrical circuit through the mechanical switch mechanism, the actuator mechanism comprising an output member movable in response to supply of electrical power from the timing module power output, and a mechanical actuator arrangement interconnected between for acting on the mechanical switch mechanism switch mechanism for acting on the mechanical switch mechanism for selectively providing power to the electrical circuit through the mechanical switch mechanism in response to electrical power supplied to the power output of the timing module;

wherein the timing module power output is interconnected in the electrical circuit by means of a circuit board to which power is supplied from the electrical circuit, and from which power is supplied to the timing module power input.

9. The timing device of claim 8, further comprising a plurality of terminals for connecting the timing device in the electrical circuit, and wherein the timing module includes a plurality of prongs defining the power input and the power output of the timing module, and wherein the circuit board is interconnected with the timing module prongs and with at least one of the terminals.

10. The timing device of claim 8, wherein the timing module is mounted to a first plate, and wherein the circuit board is mounted to the timing module.

11. The timing device of claim 10, wherein the actuator mechanism output member comprises the extendable and retractable plunger of a solenoid, wherein the solenoid is interconnected with the circuit board for receiving power from the timing module through the circuit board so as to selectively move the solenoid plunger, and wherein the mechanical actuator arrangement is interconnected with the solenoid plunger, and wherein the solenoid is mounted to a second plate spaced from the first plate.

12. The timing device of claim 11, wherein the mechanical switch mechanism and the plurality of terminals are located between the first and second plates.

13. In a timing module including a power input, a timing device, and a switch operable in response to the timing device for selectively providing power to a power output; the improvement comprising a switching mechanism adapted for interposition between the electrical circuit and the timing module, comprising:

a switch connectable in the circuit for controlling the supply of electrical power through the circuit;

a power input for providing electrical power to the timing module power input from the electrical circuit; and an actuator mechanism interposed between the switch and the timing module for selectively actuating the switch in response to electrical power from the power output of the timing module, to selectively supply electrical power in the electrical circuit responsive to actuation of the switch by the actuator mechanism.

14. A method of connecting a timing module in an electrical circuit, the timing module including a power input, and a switch operable in response to a timing device for selectively providing power to a power output, comprising the steps of:

providing power to the timing module power input from the electrical circuit;

connecting a mechanical switch in the electrical circuit to control the supply of power in the circuit;

providing an actuating mechanism engageable with the mechanical switch and being capable of opening and closing the switch; and interconnecting the actuating mechanism with the timing module power output, wherein operation of the timing module to supply and cut off power to the timing module power output results in selective operation of the actuating mechanism, to control opening and closing of the switch to control the supply of power in the electrical circuit.

* * * * *

UNITED STATES PATENT AND TRADEMARK OFFICE

CERTIFICATE OF CORRECTION

PATENT NO. : 5,266,841

DATED : November 30, 1993

INVENTOR(S) : DAVID D. FLEGEL

It is certified that error appears in the above-identified patent and that said Letters Patent is hereby corrected as shown below:

Claim 1, column 5-6, lines 68-1, delete "electric" and substitute therefor -- electrical --; Claim 8, column 8, line 4, after "between" insert -- the movable output member and the mechanical switch mechanism --; Claim 8, column 8, lines 5-7, after "mechanism" delete "switch mechanism for acting on the mechanical switch mechanism"

Signed and Sealed this

Third Day of May, 1994

*Attest:*

Bruce Lehman

BRUCE LEHMAN

*Attesting Officer*

*Commissioner of Patents and Trademarks*